US011185466B2

(12) United States Patent
Ma

(10) Patent No.: US 11,185,466 B2
(45) Date of Patent: Nov. 30, 2021

(54) FEMALE SEX TOY WITH ACTION SENSING ABILITY

(71) Applicant: SHENZHEN SIRENSTECH CO., LTD, Shenzhen (CN)

(72) Inventor: Rong Ma, Shenzhen (CN)

(73) Assignee: SHENZHEN SIRENSTECH CO., LTD, Shenzhen (CN)

( * ) Notice: Subject to any disclaimer, the term of this patent is extended or adjusted under 35 U.S.C. 154(b) by 334 days.

(21) Appl. No.: 16/463,005

(22) PCT Filed: Aug. 10, 2017

(86) PCT No.: PCT/CN2017/096802

§ 371 (c)(1),
(2) Date: May 22, 2019

(87) PCT Pub. No.: WO2018/095076

PCT Pub. Date: May 31, 2018

(65) Prior Publication Data

US 2019/0321254 A1 Oct. 24, 2019

(30) Foreign Application Priority Data

Nov. 23, 2016 (CN) ..... 201621256392.9

(51) Int. Cl.
*A61H 19/00* (2006.01)
*A61H 23/02* (2006.01)

(52) U.S. Cl.
CPC ..... *A61H 19/44* (2013.01); *A61H 23/02* (2013.01); *A61H 2201/169* (2013.01);
(Continued)

(58) Field of Classification Search
CPC ..... A61H 19/44; A61H 23/02; A61H 19/40; A61H 19/50; A61H 21/00
See application file for complete search history.

(56) References Cited

U.S. PATENT DOCUMENTS 10,231,901 B2 * 3/2019 Swartz ..... A61H 19/34
2009/0171144 A1 * 7/2009 Squicciarini ..... A61F 2/26 600/38

(Continued)

FOREIGN PATENT DOCUMENTS

CN 102716005 A 10/2012
CN 103110505 A 5/2013
CN 204964079 U 1/2016

OTHER PUBLICATIONS

International Search Report of PCT Patent Application No. PCT/CN2017/096802 dated Oct. 26, 2017.

*Primary Examiner* — John P Lacyk

(57) ABSTRACT

A female sex toy with an action sensing ability, comprising a penis-like insertion portion adapted to be inserted into the vagina and a control circuit board provided with a control chip. An external gel wraps the penis-like insertion portion; the penis-like insertion portion comprises multiple pressure strain structures which all contact the inner side of the external gel, and each of the pressure strain structures is provided with a pressure sensor, which is electrically connected to the control chip of the control circuit board; after the penis-like insertion portion is inserted into the vagina, the external force is transmitted to the pressure strain structures through the external gel and causes deformation, and the pressure sensors measure and acquire, in real time, the external force which causes the deformation of the pressure strain structures, and send external force information to the control chip to form body feeling data.

8 Claims, 2 Drawing Sheets

(52) U.S. Cl.
CPC ..... *A61H 2201/5007* (2013.01); *A61H 2201/5028* (2013.01); *A61H 2201/5071* (2013.01)

(56) References Cited

U.S. PATENT DOCUMENTS

2009/0281397 A1* 11/2009 Lavoisier ..... A61H 21/00 600/301
2014/0163437 A1* 6/2014 Mack ..... A61H 19/30 601/46
2014/0336452 A1* 11/2014 Shahoian ..... A61H 23/0263 600/38

* cited by examiner

FEMALE SEX TOY WITH ACTION SENSING ABILITY

BACKGROUND

1. Technical Field

The present invention relates to a sex product, in particular to a female sex toy with an action sensing ability.

2. Description of Related Art

Regarding the traditional sex products, the control system is usually the product disposed with control buttons, or a matching wired controller or wireless remote control, or remote control terminal based on Internet technology, including Internet access devices such as computers and mobile phones.

The above control method requires a person to participate in the manipulation, however, the operation is cumbersome and fatigued, and the user experience is poor. Especially in the interactive experience of two or more people, the operator can only operate the control system with subjective judgment, and the final interactive effect is more similar to the masturbation assisted by others, rather than authentic sex.

SUMMARY

The purpose of the present invention is to provide a female sex toy with an action sensing ability that can automatically collect user's sensations or body feeling information through sensors to realize an immersive sex experience without human intervention.

The technical solution of the present invention is as follows: a female sex toy with an action sensing ability, comprising a penis-like insertion portion adapted to be inserted into a vagina and a control circuit board provided with a control chip. An external gel wraps the penis-like insertion portion; the penis-like insertion portion comprises one or multiple pressure strain structures which all contact the inner side of the external gel, and each of the pressure strain structures is provided with a pressure sensor which is electrically connected to the control chip of the control circuit board and an annular member supporting the pressure sensor; wherein, the annular member and the inner side of the external glue are in contact and the pressure sensor is disposed on the inner side or the outer side of the annular member; after the penis-like insertion portion is inserted into the vagina, an external force is transmitted to the annular member of the pressure strain structures through the external gel of the penis-like insertion portion and causes radial deformation, and the pressure sensors measure and acquire, in real time, the external force which causes the radial deformation of the annular member, and send external force information to the control chip to form body feeling data.

Preferably, the penis-like insertion portion further comprises: a first inner frame having a penis shape; wherein the external gel wraps the first inner frame, each of the pressure strain structures is sleeved on an outer surface of the first inner frame, and each of the pressure strain structures is sandwiched between the first inner frame and the external gel.

Preferably, the penis-like insertion portion further comprises: a first vibration motor for generating a surge-type reciprocating vibration; wherein the first vibration motor is disposed in the first inner frame.

Preferably, the female sex toy with an action sensing ability further comprises: a connection portion and a hand-held portion having the control circuit board disposed therein; wherein the connection portion connects the hand-held portion and the penis-like insertion portion, and the external gel wraps the outer side of the connection portion and the outer side of the hand-held portion.

Preferably, the hand-held portion further comprises: a second inner frame, and a second vibration motor and a battery disposed in the second inner frame; wherein the external gel wraps an outer side of the second inner frame, the control circuit board is disposed in the second inner frame, and the battery and the second vibration motor are respectively electrically connected to the control circuit board.

Preferably, the hand-held portion is further provided with a charging interface for charging the battery, and a switch button for controlling the female sex toy with an action sensing ability to be powered on or off and for implementing mode switching; wherein the charging interface is electrically connected to the battery, and the switch button is disposed at an end of the hand-held portion and electrically connected to the control circuit board; wherein the charging interface is a magnetic, a jack or a coupling coil charging interface.

Preferably, the connection portion is a bendable connecting rod.

Preferably, the pressure sensor is a strain gauge pressure sensor, a ceramic pressure sensor or a piezoelectric pressure sensor.

Preferably, the annular member is made of plastic, metal, wood or ceramic material.

Compared with the prior art, the technical solution provided by the present invention has the following beneficial effects.

1. The penis-like insertion portion of the female sex toy having an action sensing ability is provided with a pressure strain structure capable of detecting and collecting external force in real time. Therefore, real-time monitoring of multi-point pressure values can be realized, and the analysis of body feeling action can be realized by integrating these pressure values.

2. An annular member and a pressure sensor disposed on the annular member are disposed in the pressure strain structure, and the annular member and the pressure sensor cooperate with each other to realize pressure value detection in a 360-degree annular region. When the user is using the female sex toy with an action sensing ability, there is no need to deliberately find the sensing point, and it can be sensitively identified by swiping or pressing the annular sensing area from any position.

3. When the first vibration motor is disposed in the first inner frame of the penis-like insertion portion, the effect of surge-type reciprocating vibration can be realized by controlling the rotation speed change of the first vibration motor, thereby further improving the user experience of the female sex toy with an action sensing ability.

DESCRIPTION OF THE EXEMPLARY EMBODIMENTS

The technical solutions in the embodiments of the present invention will be clearly and completely described in conjunction with the drawings in the embodiments of the present invention. It is obvious that the described embodiments are only a part of the embodiments of the present invention, and not all of the embodiments. The features of the embodiments and examples described below can be combined with each other without conflict. All other embodiments obtained by those skilled in the art based on the embodiments of the present invention without creative efforts are within the scope of the present invention.

It should be noted that in the present invention, when one component is considered to be "connected" to another component, it may be directly connected to another component or may be indirectly connected to another component through the intervening component.

All technical and scientific terms used herein have the same meaning as commonly understood by one of ordinary skill in the art to the invention. The terminology used in the description of the present invention is for the purpose of describing particular embodiments, and is not intended to limit the invention.

Figure 1:
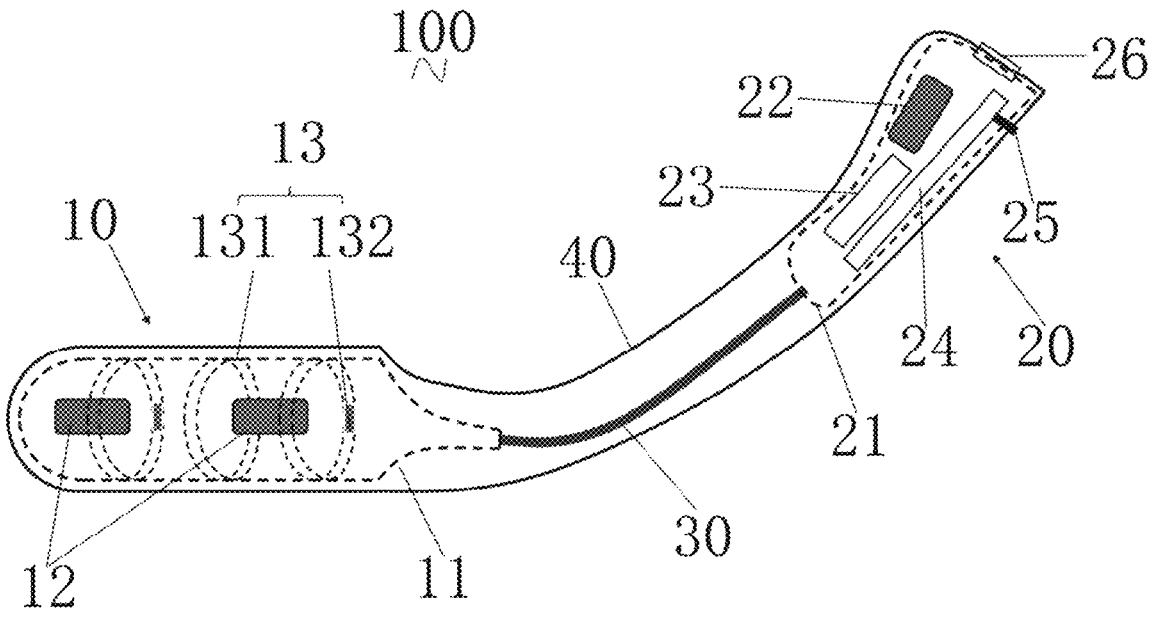
FIG. 1 is a schematic structural view of the female sex toy with an action sensing ability according to an embodiment of the present invention.
Figure 2:
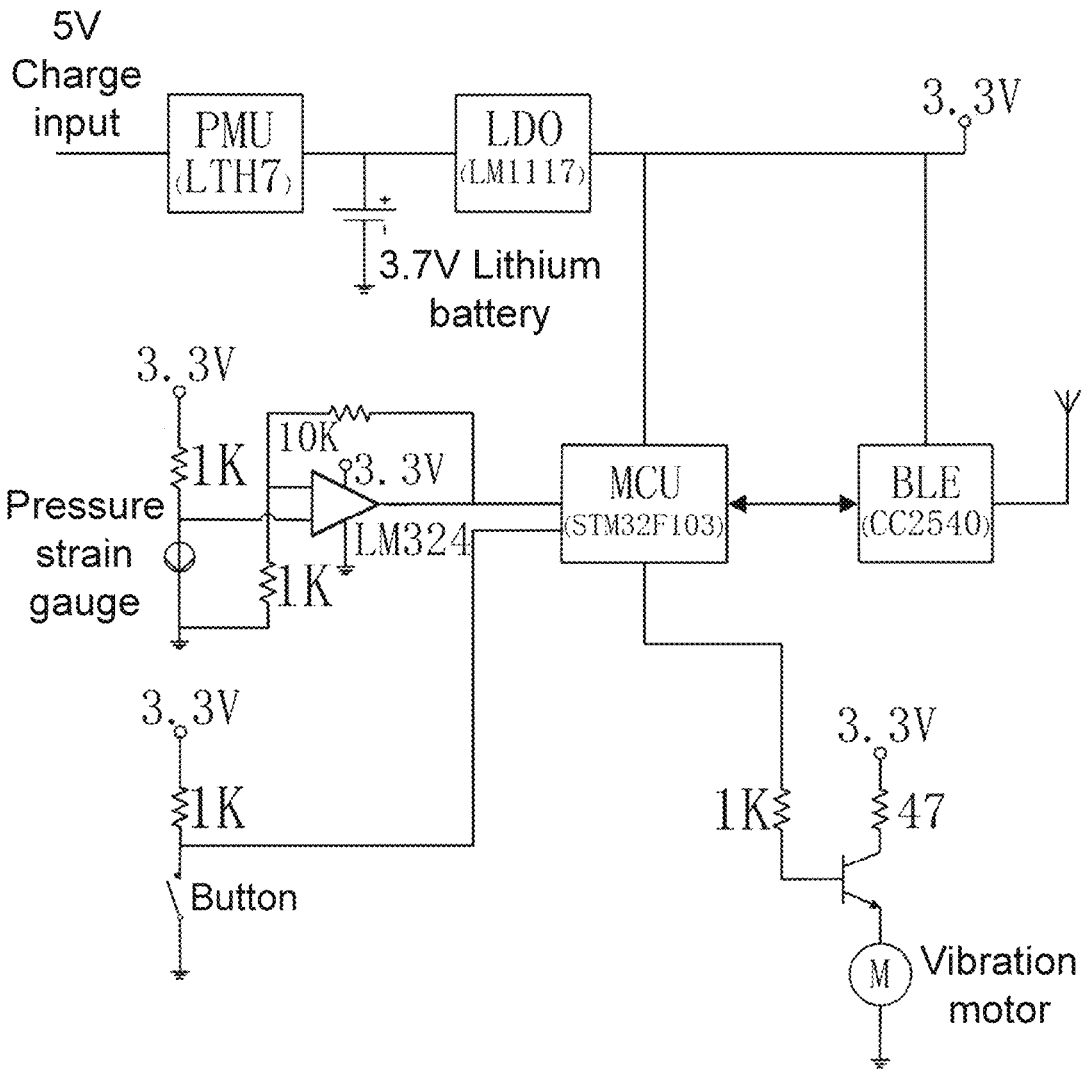
FIG. 2 is a schematic diagram showing the circuit structure of the female sex toy with an action sensing ability shown in FIG. 1.

Referring to FIG. 1 and FIG. 2, a female sex toy with an action sensing ability 100 provided by the present invention includes: a penis-like insertion portion 10, a hand-held portion 20, and a connection portion 30 configured to connect the penis-like insertion portion 10 and the hand-held portion 20 and an external gel 40. In the present embodiment, the penis-like insertion portion 10, the hand-held portion 20, and the connection portion 30 are all wrapped with the external gel 40. Alternatively, the external gel 40 may be a silicone rubber having better elasticity.

The penis-like insertion portion 10 is for insertion into a woman's vagina and includes a first inner frame 11, at least one first vibration motor 12, and multiple pressure strain structures 13.

The first inner frame 11 has a penis shape and provides a receiving space.

The first vibration motor 12 is configured to generate a surge-type reciprocating vibration and being housed in the receiving space of the first inner frame. In the present embodiment, the penis-like insertion portion 10 is provided with two first vibration motors 12, but the present invention is not limited thereto. The penis-like insertion portion 10 may further be provided with one or at least three first vibration motors 12, as long as the requirements of surge-type reciprocating vibration of the product can be met, which is not limited by the present invention.

The multiple pressure strain structures 13 are sleeved on the outer surface of the first inner frame 11 at intervals in an opposite and parallel manner, and are in contact with the inner side of the external gel 40; that is, each of the pressure strain structures 13 is sandwiched between the first inner frame 11 and the external gel 40. In the present embodiment, the multiple pressure strain structures 13 are used to realize real-time monitoring of multi-point pressure values in the penis-like insertion portion 10, and the analysis of the body feeling action is realized by the above-described pressure values.

Specifically, each of the pressure strain structures 13 includes an annular member 131 and a pressure sensor 132 disposed on the annular member 131. The annular member 131 is sleeved on an outer surface of the first inner frame 11 and supports the pressure sensor 132. The annular member 131 is in contact with the inner side of the external gel 40, and the pressure sensor 132 is disposed on the inner side or the outer side of the annular member 131.

In the present embodiment, the pressure sensor 132 may be a strain gauge pressure sensor, a ceramic pressure sensor, or a piezoelectric pressure sensor, such as a resistance strain gauge or the like. The pressure sensor 132 is disposed on the inner side or the outer side of the annular member 131 by adhesive bonding or structural design. Alternatively, the annular member 131 may be fabricated from plastic, metal, wood, ceramic or other materials having similar hardness and toughness.

In the penis-like insertion portion 10, an external force is transmitted to the annular member 131 of each of the pressure strain structures 13 through the external gel 40 of the penis-like insertion portion 10 and the deformation of the annular member 131 is thus caused, and the pressure sensors 132 measure and acquire, in real time, the external force which causes the deformation of the annular member 131.

The hand-held portion 20 is for hand-held use and includes a second inner frame 21 and a second vibration motor 22, a battery 23, and a control circuit board 24 which are disposed in the second inner frame 21. The outer side of the second inner frame 21 is wrapped with the external gel 40, and the battery 23 and the second vibration motor 22 are electrically connected to the control circuit board 24, respectively.

Further, the hand-held portion 20 is further provided with a charging interface 25 for charging the battery 23, and a switch button 26 for controlling the female sex toy with an action sensing ability to be powered on or off and for implementing mode switching.

A control chip (MCU) is disposed on the control circuit board 24, and the control chip is electrically connected to the battery 23 and the second vibration motor 22, respectively. In this embodiment, the control chip is a microcontroller of the type STM32F103. In this embodiment, the charging interface 25 can be a magnetic, a jack or a coupling coil charging interface. The charging interface 25 is electrically connected to the battery 23, and the switch button 26 is disposed at an end of the hand-held portion 20 and is electrically connected to a control chip of the control circuit board 24.

Between the penis-like insertion portion 10 and the hand-held portion 20, the first vibration motor 12 and the pressure sensor 132 of the penis-like insertion portion 10 are electrically connected to the control chip of the control circuit board 24. It should be understood that the control chip of the control circuit board 24 can receive and analyze the external force information collected by the pressure sensor 132 to form the body feeling data, and further control the operation state of the first vibration motor 12 and the second vibration motor 22 based on the body feeling data.

The connection portion 30 is a bendable connecting rod, and the outer side of the connecting rod is wrapped with the external gel 40. In this embodiment, the two ends of the connecting rod of the connection portion 30 are respectively connected to the first inner frame 11 and the second inner frame 21, thereby achieving the connection of the penis-like insertion portion 10 and the hand-held portion 20.

When the female sex toy having an action sensing ability is used, the penis-like insertion portion 10 is inserted into the vagina, and if an external force acts on the corresponding region on the external gel 40 of the penis-like insertion portion 10, the external force is transmitted to the annular member 131 of each of the pressure strain structures 13 through the external gel 40, causing the annular member 131 to deform. The deformation of the annular member 131 is transmitted to the pressure sensor 132, causing its outer shape to expand and contract, thereby changing the impedance of the pressure sensor 132. The control chip of the control circuit board 24 connected to the pressure sensor 132 can measure this impedance change in real time to determine the external force on the external gel 40, thereby forming the body feeling data in the vagina. Further, by arranging the multiple pressure-strain structures 13 in the penis-like insertion portion 10, real-time monitoring of the multi-point pressure values can be realized, and the analysis of the body feeling action can be realized by integrating these pressure values.

Optionally, the female sex toy with an action sensing ability 100 can be interconnected with a host computer or other sex toys through a wireless or data line, thereby realizing the body feeling data interaction between the devices and implementing a variety of sex experience games, such as stand-alone gameplay, video or game interactive gameplay and device interaction.

If the female sex toy with an action sensing ability 100 is wirelessly interconnected with a host computer or other sex toys, it should be understood that the female sex toy with an action sensing ability 100 may also be provided with a wireless module, such as a Bluetooth BLE module of the type CC2540. If the female sex toy with an action sensing ability 100 is interconnected with a host computer or other sex toys through a data line, the charging interface 25 may also be used as a data transmission interface, thereby transmitting external body feeling data to the control chip of the control circuit board 24 through the charging interface 25 so as to implement the interaction between the female sex toy with an action sensing ability 100 and external devices.

Compared with the prior art, the technical solution provided by the present invention has the following beneficial effects:

1. The penis-like insertion portion of the female sex toy having an action sensing ability is provided with a pressure strain structure capable of detecting and collecting external force in real time. Therefore, real-time monitoring of multi-point pressure values can be realized, and the analysis of body feeling action can be realized by integrating these pressure values.

2. An annular member and a pressure sensor disposed on the annular member are disposed in the pressure strain structure, and the annular member and the pressure sensor cooperate with each other to realize pressure value detection in a 360-degree annular region. When the user is using the female sex toy with an action sensing ability, there is no need to deliberately find the sensing point, and it can be sensitively identified by swiping or pressing the annular sensing area from any position.

3. When the first vibration motor is disposed in the first inner frame of the penis-like insertion portion, the effect of surge-type reciprocating vibration can be realized by controlling the rotation speed change of the first vibration motor, thereby further improving the user experience of the female sex toy with an action sensing ability.

The above is only the embodiment of the present invention, and it should be noted that those skilled in the art can make improvements without departing from the concept of the present invention, but these are all the scope of protection of the present invention.

What is claimed is:

1. A female sex toy with an action sensing ability, comprising:

a penis-like insertion portion adapted to be inserted into a vagina;

a control circuit board provided with a control chip;

an external gel wraps the penis-like insertion portion;

wherein the penis-like insertion portion comprises a first inner frame, at least one first vibration motor, and multiple pressure strain structures;

wherein first inner frame has a penis shape and provides a receiving space;

the multiple pressure strain structures are sleeved on an outer surface of the first inner frame at intervals in a parallel manner and are in contact with an inner side of the external gel;

wherein each of the pressure strain structures comprises an annular member and a pressure sensor disposed on the annular member; the annular member is sleeved on the outer surface of the first inner frame and supports the pressure sensor; the annular member is in contact with the inner side of the external gel, and the pressure sensor is disposed on an inner side or an outer side of the annular member;

if an external force acts on a corresponding region on the external gel, the external force is transmitted to the annular member of each of the pressure strain structures through the external gel, causing the annular member to deform; wherein a deformation of the annular member is transmitted to the pressure sensor, causing its outer shape to expand and contract, thereby changing an impedance of the pressure sensor; wherein the control chip connected to the pressure sensor can measure this impedance change in real time to determine the external force on the external gel, thereby forming the body feeling data in the vagina;

wherein the annular member and the pressure sensor cooperate with each other to realize pressure value detection in a 360-degree annular region.

2. The female sex toy with an action sensing ability according to claim 1, wherein the penis-like insertion portion further comprises a first vibration motor for generating a surge-type reciprocating vibration;

wherein the first vibration motor is disposed in the first inner frame.

3. The female sex toy with an action sensing ability according to claim 1, further comprising:

a connection portion; and a hand-held portion having the control circuit board disposed therein;

wherein the connection portion connects the hand-held portion and the penis-like insertion portion, and the external gel wraps the outer side of the connection portion and the outer side of the hand-held portion.

4. The female sex toy with an action sensing ability according to claim 3, wherein the hand-held portion further comprises:

a second inner frame; and a second vibration motor and a battery disposed in the second inner frame;

wherein the external gel wraps an outer side of the second inner frame, the control circuit board is disposed in the second inner frame, and the battery and the second vibration motor are respectively electrically connected to the control circuit board.

5. The female sex toy with an action sensing ability according to claim 4, wherein the hand-held portion is further provided with a charging interface for charging the battery, and a switch button for controlling the female sex toy with an action sensing ability to be powered on or off and for implementing mode switching;

wherein the charging interface is electrically connected to the battery, and the switch button is disposed at an end of the hand-held portion and electrically connected to the control circuit board; and wherein the charging interface is a magnetic, a jack or a coupling coil charging interface.

6. The female sex toy with an action sensing ability according to claim 3, wherein the connection portion is a bendable connecting rod.

7. The female sex toy with an action sensing ability according to claim 1, wherein the pressure sensor is a strain gauge pressure sensor, a ceramic pressure sensor or a piezoelectric pressure sensor.

8. The female sex toy with an action sensing ability according to claim 1, wherein the annular member is made of plastic, metal, wood or ceramic material.

* * * * *